United States Patent [19]

Tyler

[11] Patent Number: 4,796,385

[45] Date of Patent: Jan. 10, 1989

[54] GATE LOCKING DEVICE

[76] Inventor: Michael E. Tyler, One Medical Park Pla., 14615 San Pedro, San Antonio, Tex. 78232

[21] Appl. No.: 83,314

[22] Filed: Aug. 5, 1987

[51] Int. Cl.[4] ..... E05D 7/00

[52] U.S. Cl. ..... 49/280; 49/340

[58] Field of Search ..... 49/280, 340

[56] References Cited

U.S. PATENT DOCUMENTS

| | | | |
|---|---|---|---|
| 2,556,361 | 12/1946 | Coleman . | |
| 2,582,666 | 1/1952 | Young | 49/280 |
| 3,440,764 | 4/1969 | Cover | 49/280 |
| 3,500,585 | 3/1970 | Vollmar | 49/280 |
| 4,214,783 | 7/1980 | Boegcman . | |
| 4,240,278 | 12/1980 | Cinder . | |
| 4,262,503 | 4/1981 | Kuebler . | |
| 4,330,958 | 5/1982 | Richmond | 49/280 |
| 4,361,985 | 12/1982 | DeMarco | 49/280 |
| 4,420,296 | 12/1983 | Andeboy | 48/280 X |
| 4,495,730 | 1/1985 | Kennedy | 49/280 |
| 4,512,105 | 4/1985 | Norton . | |
| 4,545,150 | 10/1985 | Williams . | |
| 4,665,649 | 5/1987 | Hund, Jr. | 49/280 |

*Primary Examiner*—Kenneth J. Dorner
*Assistant Examiner*—James R. Brittain
*Attorney, Agent, or Firm*—David G. Henry

[57] ABSTRACT

An automatic gate opener lock. The gate opener lock has a locking bolt which is moved between locked and unlocked positions by the movement of swing arm of an automatic gate opener. To prevent movement of the locking bolt toward its locked position before the gate is closed, springs are arranged for resisting movement in that direction. The springs have a combined resistive force greater than the force required to move the gate. Only when the gate is closed, and the force from the swing arm may no longer be dissipated through gate movement, is the combined force of the springs overcome, and the locking bolt moved into the locked position.

9 Claims, 2 Drawing Sheets

GATE LOCKING DEVICE

BACKGROUND OF THE INVENTION

1. Field of the Invention.

The present invention relates to remotely controlled devices for controlling access through gates.

2. Discussion of the Prior Art.

Devices for remotely opening and closing gates and doors are known in the art, as are devices for remotely locking gates and doors. Presently, electrically operated gate opening and closing devices are in widespread use. These gate opening and closing devices are of limited use for preventing persons from entering or exiting, because the devices do not actually lock the free-swinging end of the gate adjacent to the fence post. Therefore, particularly with a wide gate which may be easily bent, a person may merely push or pull the free-swinging edge of a closed gate enough to pass through. Separate remotely-controlled locking devices are often installed on such gates to solve this problem. A person requiring remotely controlled opening, closing, and locking will, therefore, be forced to purchase a rather expensive remotely controlled locking device in addition to the likewise expensive remotely-controlled gate opening and closing device.

It would be advantageous to devise a simple and inexpensive apparatus which adapts existing gate opening and closing devices to lock the free-swinging end of the gates on which the devices are installed.

SUMMARY OF THE INVENTION

An automatic gate opener lock. The gate opener lock has a locking bolt which is moved between locked and unlocked positions by the movement of swing arm of an automatic gate opener. To prevent movement of the locking bolt toward its locked position before the gate is closed, springs are arranged for resisting movement in that direction. The springs have a combined resistive force greater than the force required to move the gate. Only when the gate is closed, and the force from the swing arm may no longer be dissipated through gate movement, is the combined force of the springs overcome, and the locking bolt moved into the locked position.

DETAILED DESCRIPTION OF THE PREFERRED EMBODIMENT

The present invention comprises a locking apparatus for commercially available gate opening and closing devices.

Figure 1:
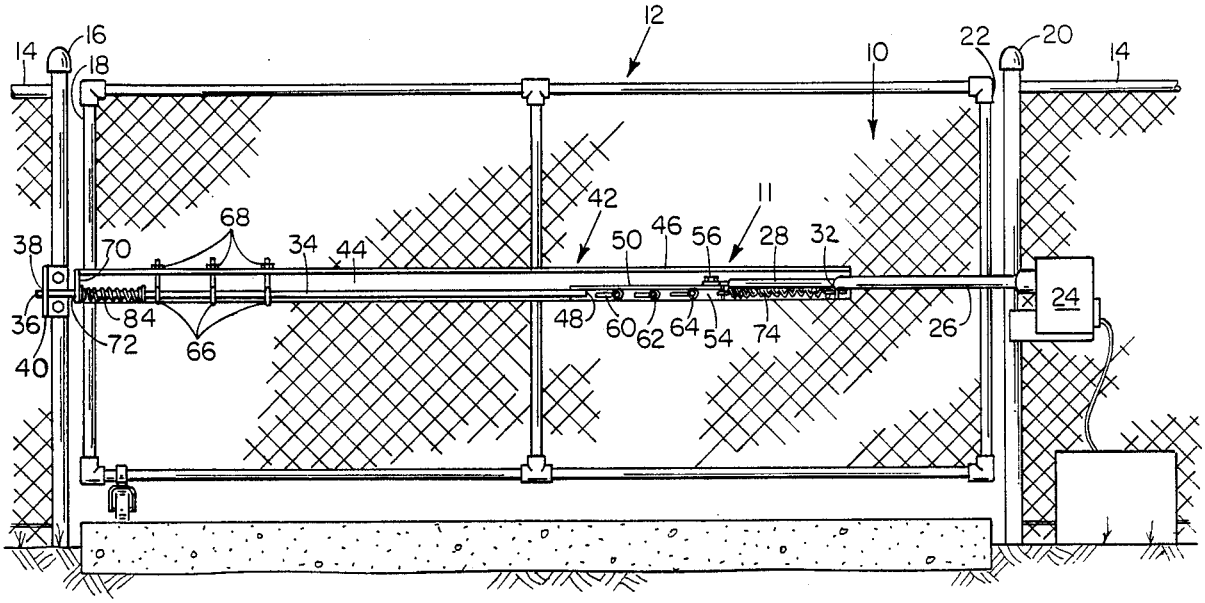
FIG. 1 shows the locking apparatus mounted on a swinging outdoor gate.

Referring to FIG. 1, the system consisting of the opening and closing device and the locking apparatus is referred to generally by the reference numeral 10. The locking apparatus is referred to by the reference numeral 11. The system 10 is shown installed on an outdoor fence having a radially-swinging gate 12. The gate 12 lies between two stationary fence sections 14. A jamb post 16 stands adjacent to the swinging edge 18 of the gate 12. A support post 20 stands adjacent to and supports the pivotal end 22 of gate 12. The gate opener 24 is shown mounted to the support post 20.

Referring again to FIG. 1, the gate opener 24 has a swing arm 26 with a telescopically received cylinder 28 extending from its distal end 32. When the gate 12 is to be closed, the gate opener 24 is activated and the swing arm 26 travels radially in a direction which pushes the gate 12 toward its closed position. As the swing arm 26 travels, the cylinder 28 extends outwardly toward the swinging edge 18 of the gate 12. The gate opener 24 is designed so that the cylinder 28 continues to extend after the gate 12 reaches a fully closed position. The extension stops when a pre-determined tension is reached. When the gate 12 is to be opened, the process is reversed with the cylinder 28 retracting and the swing arm 26 travelling radially in the reverse direction.

Without the addition of the locking apparatus 11, the distal end 32 of the cylinder 28 is typically attached directly to the gate 12. Because the swing arm 26 of the gate opener 24 of the type just described intersects the gate 12 at variant orientations during movement of the gate 12, the distal end 32 of the cylinder 28 is pivotally attached to the gate 12.

The extension of the cylinder 28 after the gate 12 is closed, as mentioned above, usually only creates tension on the gate 12 to help hold it in its closed position. The present invention uses this after-closing telescopic movement to move a locking bolt 34 between an extended-locked position and a retracted-unlocked position. In the extended-locked position, a distal end 36 of the locking bolt 34 extends through a hole 38 of a bolt receiver 40. The bolt receiver 40 is mounted on the jamb post 16.

Referring in combination to FIGS. 1, 2, 3, 4, and 5, the locking apparatus 11 further includes a support member 42 which is attached to the gate 12. The support member 42 serves as a mounting and support platform for the remaining components of the locking apparatus 11. The support member 42 of the preferred embodiment is constructed of 90° angle iron which is attached to the gate 12 so that one face (the vertical face 44) is vertically oriented and abuts the gate 12. The support member 42 is oriented so that its other face (the horizontal face 46) faces the top of the gate 12.

Figure 2:
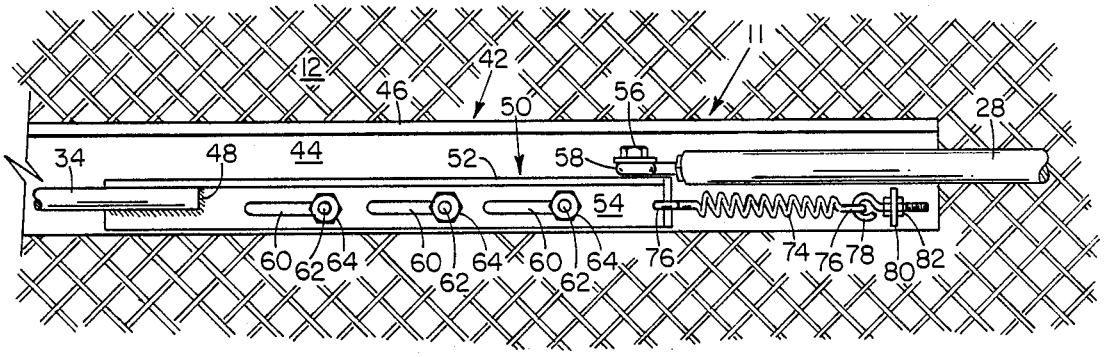
FIG. 2 shows a portion of the locking apparatus closest to the pivotal end of the gate.
Figure 3:
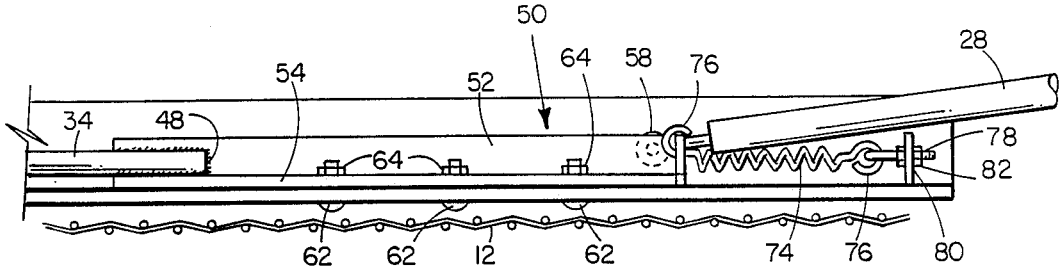
FIG. 3 is a bottom view of FIG. 2.

Referring in combination to FIGS. 1, 2, and 3, because a force pushing on the proximal end 48 of the locking bolt 34 other than parallel with its longitudinal axis would tend to bend the locking bolt 34 causing it to jam, and because the cylinder 28 pushes from varying directions during movement of the gate 12, the locking bolt 34 is not attached directly to the cylinder 28. Instead, a force transmission member 50 is used to direct the pushing force from the cylinder 28 in the proper direction.

Referring in combination to FIGS. 2 and 3, the force transmission member 50 is, in the preferred embodiment, made of 90° angle iron which is smaller than that forming the support member 42. The force transmission member 50 is oriented in the same manner as the support member 42, with a horizontal face 52 facing the top of the gate 12 and a vertical face 54 adjacent to the vertical face 44 of the support member 42. The distal end 32 of the cylinder 28 is pivotally attached to the horizontal face 52 of the force transmission member 50 through connection of a bolt 56 and an eyebolt 58.

Referring again to FIGS. 2 and 3 in combination, the force transmission member 50 has a plurality of longitudinal slots 60 in its vertical face 54. Bolts 62 pass through the vertical face 44 of the support member 42 and through the longitudinal slots 60. Nuts 64 which are threaded on to the bolts 62 secure the force transmission member 50 to the support member 42. The bolts 62 are designed so that the nuts 64, when fully tightened, allow the force transmission member 50 to move on the support member 50 to the extent allowed by the longitudinal slots 60. When mounted in this manner, the force transmission member 50, regardless of the direction of force applied to it, may only move, if at all, parallel with the longitudinal axis of the locking bolt 34.

The length of the longitudinal slots 60 of the force transmission member 50 and the placement on the support member 42 of the bolts 62 are such that the force transmission member 50 may move sufficiently to move the locking bolt 34 between its locked and unlocked positions; that is, to move the distal end 36 of the locking bolt 34 in and out of the hole 38 in the bolt receiver 40.

Referring to FIGS. 1 through 5, the locking bolt 34 is, in the preferred embodiment, a rod-like member which is welded, at its proximal end 48, to the force transmission member 50. The length of the locking bolt 34 is determined by the width of the gate 12. Near its distal end 36, the locking bolt 34 passes through and is supported by a plurality of eye bolts 66 which extend downwardly from the horizontal face 46 of the support member 42 and are held in place by nuts 68. An end plate 70 is mounted on the support member 42 on the end nearest the jamb post 16, and lies perpendicular to the planes of the horizontal face 46 and the vertical face 44 of the support member 42. The end plate 70 has a hole 72 which is a passage for the locking bolt 34 as it extends toward the bolt receiver 40. The hole 72 of the end plate 70 is only large enough for the locking bolt 34 to pass through. The end plate 70 provides stability for the locking bolt 34 near the distal end 36. This enhances the resistance of the locking bolt 34 to bending under pressure from attempts to pull the gate 12 open while the locking bolt 34 is extended.

As the cylinder 28 pushes against the force transmission member 50 while the gate 12 is being closed, the force transmission member 50 tends to move toward the swinging edge 18 of the gate 12, and consequently tends to push the locking bolt 34 toward its locked position. A mechanism is necessary for preventing extension of the locking bolt 34 before the gate 12 is fully closed. The preferred embodiment of the present invention includes springs to accomplish this.

Referring again in combination to FIGS. 2 and 3, a spring 74 has hooked ends 76. One hooked end 76 is attached to the force transmission member 50. The other hooked end 76 of the spring 74 is connected, by means of an eye bolt 78, to a spring support plate 80 which, in turn, is attached to the support member 42. The nuts 82 on eye bolt 78 permit adjustment of the tension of the spring 74. In this configuration, the spring 74 resists movement of the force transmission member 50 toward its locked position.

Figure 4:
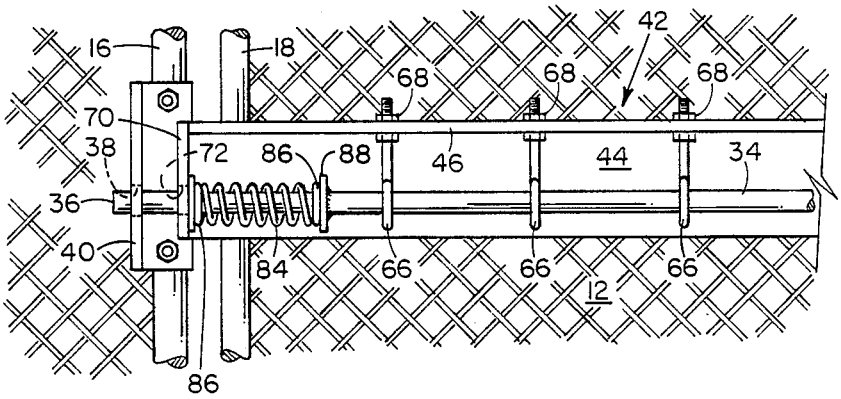
FIG. 4 is a view of a portion of the locking apparatus closest to the swinging edge of the gate.
Figure 5:
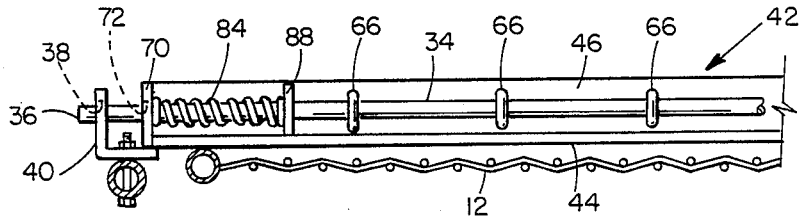
FIG. 5 is a bottom view of FIG. 4.

Referring in combination to FIGS. 4 and 5, a second spring 84 is situated on the locking bolt 34 adjacent to the end plate 70. The end plate 70 serves as an abutment for one of the ends 86 of the second spring 84. An annular flange 88 is welded onto the locking bolt 34 and serves as a second abutment for the second spring 84 for compressing the second spring 84 when the locking bolt 34 is extended toward the locking position. The annular flange 88 is positioned on the locking bolt 34 so that it contacts the second spring 84 but does not compress the second spring 84 when the locking bolt 34 is in the unlocked position.

The resistance of the spring 74 to stretching and the resistance of the second spring 84 to compression in the abovedescribed arrangement exerts a force against the extension of the locking bolt 34 toward its locked position slightly greater than the force required to move the gate 12 toward its closed position. Therefore, before the gate 12 is fully closed, when the force exerted by the cylinder 28 may be dissipated through movement of the gate 12, the locking bolt 34 remains in its retracted-unlocked position. Only when the gate 12 is fully closed and the force exerted by the cylinder 28 may no longer be so dissipated, is the combined resistive forces of the springs 74 and 84 overcome allowing the locking bolt 34 to extend into its locked position.

Ideally, the desired resistive forces of the springs 74 and 84 should be those forces exerted by them in their most relaxed state. In practice, because of the variation in gate sizes, weights, and swinging characteristics, adjustment of the tension on the springs 74 and 84 moving them away from their most relaxed state may be necessary.

Operation of the gate opener 24 having the locking apparatus 11 added is, from a user's standpoint, no different than without the locking apparatus 34; a user merely actuates the remote control (not shown) of the gate opener 24. When the gate 12 is open, the gate opener 24 responds by moving the swing arm 26 in a direction which pushes the gate 12 closed. As the swing arm 26 moves, the cylinder 28 gradually extends from the swing arm 26. The extension of the cylinder 28 and, to a lesser extent, the radial movement of the swing arm 26 in certain positions, tend to move the force transmission member 50 toward its locked position. Because of the springs 74 and 84 as above described, the forces exerted on the force transmission member 50 are translated instead into movement of the gate 12. When the gate 12 may no longer move toward its closed position, whether by fully closing or by reaching an obstruction which prevents it from moving further, the resistive forces of the springs 74 and 84 are overcome and the locking bolt 34 extends into its locked position. When properly closed, the distal end 36 of the locking bolt 34 extends into the hole 38 of the bolt receiver 40 thereby locking the gate 12.

When the gate 12 is to be opened, the user again actuates the remote control (not shown). The cylinder 28 retracts into the swing arm 26, the force transmission member 50 pulls the distal end 36 of the locking bolt 34 from the hole 38 of the bolt receiver 40, and the gate 12 is then free to swing open under force from the cylinder 28 and the swing arm 26.

Figure 6:
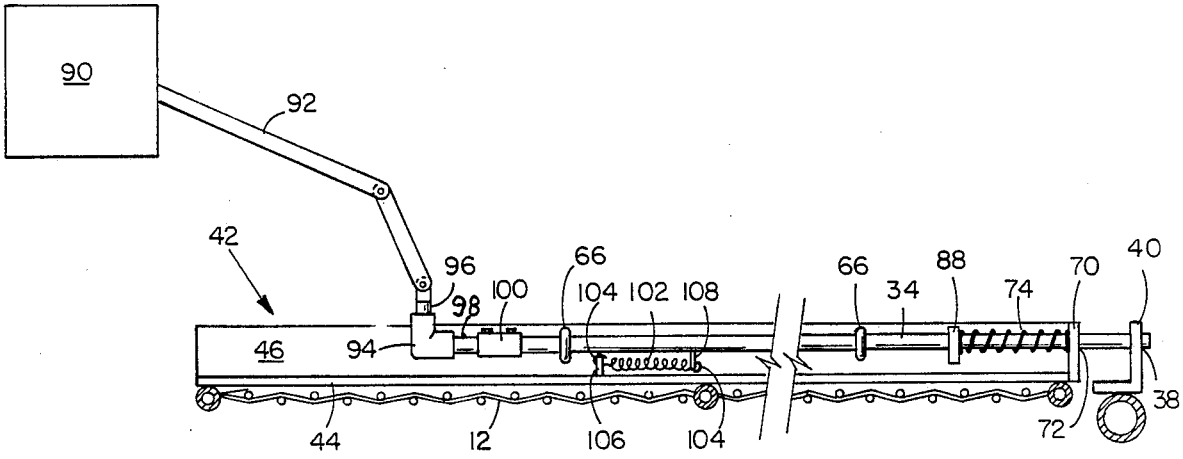
FIG. 6 is a bottom view of an alternative embodiment of the locking apparatus involving the use of a hydraulic mechanism for translating force from a gate opener to the locking bolt of the locking apparatus.

Referring to FIG. 6, an alternative embodiment of the present invention includes a locking apparatus 11 which accommodates a gate opener 24 having a swing arm 92 which does not have a telescopically moving cylinder. The swing arm 92 of such a gate opener 24 exerts force on a gate 12 which is substantially perpendicular to the gate's 12 face. To translate this perpendicular force into force parallel with the longitudinal axis of the locking bolt 34, a hydraulic apparatus 94 is substituted for the force transmission member 50. The hydraulic apparatus 94 includes a hydraulic cylinder 96 and an actuator 98. The hydraulic apparatus 94 is mounted on the gate 12 such that the swing arm 92 presses against the hydraulic cylinder 96 when the swing arm 92 moves to close the gate 12. When the hydraulic cylinder 96 is pushed, the actuator 98 extends. The locking bolt 34 is attached to the actuator 98 and is moved by a coupler 100 as the actuator 98 moves.

Referring again to FIG. 6, a spring 102 serves a function analogous to the spring 74 of the preferred embodiment. One of the ends 104 of the spring 102 is attached to a spring mounting bracket 106. The spring mounting bracket 106 is, in turn, attached to the vertical face 44 of the support member 42. The other end 104 of the spring 102 is attached to the locking bolt 34 through a spring mounting bracket 108 attached thereto.

The end result of the arrangement of this alternative embodiment is that the force from the swing arm 92 as it moves to close the gate 12 tends to extend the locking bolt 34. In the same manner as with the preferred embodiment, the locking bolt 34 does not extend until the force from the swing arm 92 may no longer be dissipated through movement of the gate 12. When the swing arm 92 moves to open the gate 12, force is removed from the hydraulic cylinder 96 which ultimately allows the actuator 98 and the locking bolt 34 to retract under force from the springs 74 and 84.

While the invention has been described in connection with the preferred embodiment, it is not intended to limit the invention to the particular forms or practices set forth, but, on the contrary, it is intended to cover such alternatives, modifications, and equivalents as may be included within the spirit and scope of the invention as defined as the appended claims.

I claim:

1. A locking apparatus for a swinging gate having a swing arm powered gate opener, said locking apparatus comprising:

a locking bolt slidably supported on said swinging gate so said locking bolt may move between an extended position for engaging bolt receiving means and a retracted position;

said swing arm powered gate opener for extending to produce a first force sufficient to move said gate from an open position to a closed position and to move said locking bolt to said extended position, and for retracting to produce a second force sufficient to move said gate from said closed position to said open position and to move said locking bolt to said retracted position;

said swing arm being attached to said gate through said locking bolt so said first force is in the direction of extending said locking bolt and so said second force is in the direction of retracting said locking bolt;

resisting means engaging said locking bolt for preventing said locking bolt from extending into said extended position until said gate reaches said closed position and for retracting said locking bolt before said second force moves said gate toward said open position, said resisting means positioned to exert a third force on said locking bolt directed against extension of said locking bolt, said first force on said locking bolt being substantially dissipated through movement of said gate until said gate reaches said closed position so said locking bolt remains retracted during said movement, and said first force overcomes said third force and extends said locking bolt when said first force is no longer dissipated through said movement, said resisting means comprising a first and a second spring, said first spring having a first resistance to stretching, said second spring having a second resistance to compression, the sum of said first and said second resistance being greater than a third resistance to moving said gate toward said closed position, said first spring being attached to said locking bolt and to said gate so said spring must be stretched for said locking bolt to extend toward said extended position, said second spring engaging said locking bolt and said gate so said second spring must be compressed for said locking bolt to extend toward said extended position, said first and said second resistance providing said third force.

2. The invention of claim 1 further comprising:

an adjustable gate spring mount for adjustably attaching a first end of said first spring to said gate;

a first spring abutment mounted on said locking bolt sized and shaped so said second spring, when placed on said locking bolt, may not move on said locking bolt past said first spring abutment; and a second spring abutment mounted on said gate and positioned adjacent to said locking bolt so said second spring, when placed on said locking bolt, may not move on said locking bolt past a point on said locking bolt adjacent to said second spring abutment, said second spring abutment being positioned closer to the swinging edge of said gate than said first spring abutment and at a position on said locking bolt relative to said first spring abutment so, when said locking bolt is in said retracted position, the distance between said first and said second spring abutments is substantially equal to said second spring's length at a substantially relaxed state;

a first end of said first spring being engaged with said adjustable gate spring mount, a second end of said first spring being welded to said locking bolt; and said second spring being placed so a portion of said locking bolt passes through said second spring's longitudinal center, said second spring being placed on said locking bolt between said first spring abutment and said point on said locking bolt adjacent to said second spring abutment.

3. A locking apparatus for a swinging gate having a swing arm powered gate opener wherein said swing arm extends and retracts for respectively moving said gate between closed and open positions comprising: a locking bolt slidably supported on said swinging gate so said locking bolt may move between an extended position for engaging bolt receiving means and a retracted position; force directing means slidably supported on said gate so said force directing means may only move substantially parallel with the longitudinal axis of said locking bolt, an end of said locking bolt being attached to a first end of said force directing means, and said swing arm being pivotally attached to a second end of said force directing means, said force directing means for directing a variably-directed first force from extension of said swing arm and a variably-directed second force from retraction of said swing arm in orientations parallel to said longitudinal axis of said locking bolt for preventing binding of said locking bolt as said locking bolt moves in response to said first and said second forces and for transmitting said first and second forces to said locking bolt; said swing arm being attached to said gate only through said force directing means so said first force is directed for extending said locking bolt and so said second force is directed for retracting said locking bolt; resisting means engaging said locking bolt and said gate for preventing said locking bolt from extending into said extended position until said gate reaches said closed position, said resisting means for exerting a third force against extension of said locking bolt, said third force being greater than the amount of said first force required to move said gate toward said closed position, said first force being substantially dissipated through movement of said gate until said gate reaches said closed position, said first force overcoming said third force and extending said locking bolt when said first force is no longer dissipated through said movement, said resisting means comprising a first and a second spring, said first spring having, at a substantially relaxed state, a first resistance to stretching, said second spring having, at a substantially relaxed state, a second resistance to compression, the sum of said first and second resistance of said springs being greater than said amount of said first force required to move said gate toward said closed position, said first spring being attached to said force directing means and to said gate so said spring must be stretched for said force directing means to move said locking bolt toward said extended position, said second spring engaging said locking bolt and said gate so said second spring must be compressed for said locking bolt to extend toward said extended position.

4. The invention of claim 3 further comprising: an adjustable gate spring mount for adjustably attaching a first end of said first spring to said gate; a first spring abutment mounted on said locking bolt sized and shaped so said second spring, when placed on said locking bolt, may not move on said locking bolt past said first spring abutment; a second spring abutment mounted on said gate and positioned adjacent to said locking bolt so said second spring, when placed on said locking bolt, may not move on said locking bolt past a point on said locking bolt adjacent to said second spring abutment, said second spring abutment being positioned closer to the swinging edge of said gate than said first spring abutment and at a position on said locking bolt relative to said first spring abutment so, when said locking bolt is in said retracted position, the distance between said first and said second spring abutments is substantially equal to said second spring's length at a substantially relaxed state; a first end of said first spring being attached to said adjustable gate spring mount, a second end of said first spring being welded to said force directing means; and said second spring being placed so a portion of said locking bolt passes through said second spring's longitudinal center, said second spring being placed on said locking bolt between said first spring abutment and said point on said locking bolt adjacent to said second spring abutment.

5. A locking apparatus for a swinging gate having a swing arm powered gate opener wherein said swing arm exerts a first force substantially perpendicular to said gate's face for moving said gate toward a closed position and exerts a second force substantially perpendicular to said gate's face for moving said gate toward an open position comprising: a locking bolt slidably supported on said swinging gate so said locking bolt may move between an extended position for engaging bolt receiving means and a retracted position; hydraulic force directing means mounted on said gate, said hydraulic force directing means having a hydraulic piston operatively engaged with an actuator, said hydraulic force directing means mounted so said swing arm moves said hydraulic piston as said swing arm moves and so said actuator, which is attached to said locking bolt, correspondingly moves said locking bolt between said extended and said retracted positions, said hydraulic force directing means for directing said first and second perpendicular forces from said swing arm in a direction parallel with the longitudinal axis of said locking bolt for effectively moving said locking bolt; and resisting means engaging said locking bolt and said gate for preventing said locking bolt from extending into said extended position until said gate reaches said closed position, said resisting means for exerting a third force on said locking bolt directed against extension of said locking bolt, said third force exerted by said resisting means being greater than the amount of said first force required to move said gate toward said closed position, said first force being substantially dissipated through movement of said gate toward said closed position until said gate reaches said closed position, said first force overcoming said third force extending said locking bolt when said first force is no longer dissipated through movement of said gate.

6. The invention of claim 5 wherein said resisting means comprises a spring engaging said gate and said locking bolt so said spring must be stretched for said locking bolt to extend toward said extended position, said spring having, at a substantially relaxed state, a resistance to stretching greater than said amount of said first force required to move said gate toward said closed position, said spring's point of attachment to said gate and to said locking bolt being positioned so said spring is held at a substantially relaxed state when said locking bolt is in said retracted position.

7. The invention of claim 5 wherein said resisting means comprises a first and a second spring, said first spring having a first resistance to stretching, said second spring having, at a substantially relaxed state, a second resistance to compression, the sum of said first and second resistance of said springs being greater than said amount of said first force required to move said gate toward said closed position, said first spring being attached to said locking bolt and to said gate so said first spring must be stretched for said locking bolt to extend toward said extended position, said second spring engaging said locking bolt and said gate so said second spring must be compressed for said locking bolt to extend toward said extended position.

8. The invention of claim 7 further comprising: an adjustable gate spring mount for adjustably attaching a first end of said first spring to said gate; a first spring abutment mounted on said locking bolt sized so said second spring, when placed on said locking bolt, may not move on said locking bolt past said first spring abutment; a second spring abutment mounted on said gate and positioned adjacent to said locking bolt so said second spring, when placed on said locking bolt, may not move on said locking bolt past a point on said locking bolt adjacent to said second spring abutment, said second spring abutment being positioned closer to the swinging edge of said gate than said first spring abutment and at a position on said locking bolt relative to said first spring abutment so, when said locking bolt is in said retracted position, the distance between said first and second spring abutments is substantially equal to said second spring's length at a substantially relaxed state; a first end of said first spring being engaged with said adjustable gate spring mount, a second end of said first spring being welded to said locking bolt; and said second spring being placed so a portion of said locking bolt passes through said second spring's longitudinal center, said second spring being placed on said locking bolt between said first spring abutment and said point on said locking bolt adjacent to said spring abutment.

9. A locking apparatus for a swinging gate having a swing arm powered gate opener wherein said swing arm extends and retracts for respectively moving said gate between closed and open positions comprising: a locking bolt slidably supported on said swinging gate so said locking bolt may move between an extended position for engaging bolt receiving means and a retracted position; force directing means slidably supported on said gate so said force directing means may only move substantially parallel with the longitudinal axis of said locking bolt, an end of said locking bolt being attached to a first end of said force directing means, and said swing arm being pivotally attached to a second end of said force directing means, said force directing means for translating a variablydirected first force from extension of said swing arm and a variably-directed second force from retraction of said swing arm in orientations parallel to said longitudinal axis of said locking bolt for preventing binding of said locking bolt as said locking bolt moves in response to said first and second forces and for transmitting said first and second forces to said locking bolt; said swing arm being attached to said gate through said force directing means so said first force is directed for extending said locking bolt and so said second force is directed for retracting said locking bolt; a first spring having, at a substantially relaxed state, a first resistance to stretching; a second spring having, at a substantially relaxed state, a second resistance to compression; the sum of said first and second resistance of said springs being greater than the amount of said first force required to move said gate toward said closed position; an adjustable gate spring mount for adjustably attaching a first end of said first spring to said gate, the first end of said first spring being attached to said adjustable gate spring mount and a second end of said first spring being attached to said force directing means so said first spring must be stretched for said force directing means to move said locking bolt toward said extended position; a first spring abutment mounted on said locking bolt sized and shaped so said second spring, when placed on said locking bolt, may not move on said locking bolt past said first spring abutment; a second spring abutment mounted on said gate and positioned adjacent to said locking bolt so said second spring, when placed on said locking bolt, may not move on said locking bolt past a point on said locking bolt adjacent to said second spring abutment, said second spring abutment being positioned closer to the swinging edge of said gate than said first spring abutment and at a position on said locking bolt relative to said first spring abutment so, when said locking bolt is in said retracted position, the distance between said first and second spring abutments is substantially equal to said second spring's length at a substantially relaxed state; said second spring being placed so a portion of said locking bolt between said first spring abutment and said point on said locking bolt adjacent to said spring abutment passes through said second spring's longitudinal center so said second spring must be compressed for said locking bolt to extend toward said extended position; said first and said second resistance for preventing said locking bolt from extending into said extended position until said gate reaches said closed position, said first force being substantially dissipated through movement of said gate until said gate reaches said closed position, said first force overcoming said combined first and second resistance and extending said locking bolt when said first force is no longer dissipated through said movement of said gate.

* * * * *